US005975681A

United States Patent [19]

Ogasawara et al.

[11] Patent Number: 5,975,681

[45] Date of Patent: Nov. 2, 1999

[54] INK JET PRINTER AND INK JET PRINT HEAD

[75] Inventors: Fumihiko Ogasawara; Toshinobu Hamazaki; Masaki Kataoka; Ichiro Tomikawa; Naoki Morita; Katsuhide Ogawa; Mitsuhide Soga; Kouji Ikegami; Jun Isozaki; Harumi Tamura; Jun Takagi; Yoshihiko Fujimura, all of Ebina, Japan

[73] Assignee: Fuji Xerox Co., Ltd., Tokyo, Japan

[21] Appl. No.: 08/802,108

[22] Filed: Feb. 19, 1997

[30] Foreign Application Priority Data

Feb. 22, 1996 [JP] Japan ..... 8-034751

[51] Int. Cl.[6] ..... B41J 2/19

[52] U.S. Cl. ..... 347/47; 347/85; 347/93

[58] Field of Search ..... 347/65, 63, 85, 347/93, 47, 44, 92, 30

[56] References Cited

U.S. PATENT DOCUMENTS

| | | | |
|---|---|---|---|
| 4,380,771 | 4/1983 | Takatori | 347/65 |
| 4,752,787 | 6/1988 | Matsumoto et al. | 347/65 |
| 5,311,214 | 5/1994 | Hirasawa | 347/30 X |
| 5,394,181 | 2/1995 | Braun | 347/92 |
| 5,450,110 | 9/1995 | Sato | 347/65 X |

FOREIGN PATENT DOCUMENTS

| | | | |
|---|---|---|---|
| 0 603 901 A2 | 6/1994 | European Pat. Off. | B41J 2/14 |
| 0 694 400 A2 | 1/1996 | European Pat. Off. | B41J 2/16 |
| 0200-6142 | 1/1990 | Japan | B41J 2/165 |
| A-3-110172 | 5/1991 | Japan | B41J 2/175 |
| 050-57894 | 3/1993 | Japan | B41J 2/045 |
| A-5-138884 | 6/1993 | Japan | B41J 2/05 |
| U-6-91874 | 4/1994 | Japan | B41J 2/05 |
| 6-270400 | 9/1994 | Japan | B41J 2/01 |
| A-7-103662 | 4/1995 | Japan | F27B 17/00 |
| A-8-295033 | 11/1996 | Japan | B41J 2/21 |

*Primary Examiner*—Joseph Hartary
*Attorney, Agent, or Firm*—Oliff & Berridge, PLC

[57] ABSTRACT

An ink jet printer which causes ink to fly to a recording medium to form an image, comprising: plural nozzles functioning as ink ejection ports; plural individual flow paths which are disposed with respectively corresponding to the nozzles, the individual flow paths respectively having driving elements which eject internal ink through the nozzles; a common liquid chamber which communicates with the individual flow paths, the common liquid chamber having an opening portion through which ink is supplied into the chamber; an ink supply path which has a sectional area smaller than a sectional area of the opening portion of the common liquid chamber, the ink supply path being connected to the opening portion to guide ink to the common liquid chamber; and an ink supply source for supplying ink through the ink supply path.

8 Claims, 10 Drawing Sheets

| | INK FLOW PIPE ($mm^2$) | INK SUPPLY DEVICE ($mm^2$) | COMMON LIQUID CHAMBER ($mm^2$) | RATIO OF SECTIONAL AREA $\left(\frac{\text{COMMON LIQUID CHAMBER}}{\text{INK SUPPLY DEVICE}}\right)$ |
|---|---|---|---|---|
| PRIOR ART | 0.79 | 5.15 | 9.06 | 1.8 |
| INVENTION 1 | 0.79 | 0.13 | 0.49 | 3.9 |
| INVENTION 2 | 0.79 | 0.39 | 1.31 | 3.4 |
| INVENTION 3 | 0.79 | 0.39 | 0.44 | 1.1 |

| | INK FLOW PIPE | INK SUPPLY DEVICE | COMMON LIQUID CHAMBER | INDIVIDUAL FLOW PATH |
|---|---|---|---|---|
| PRIOR ART | 1.00 | 0.2 | 0.1 | 6.0 |
| INVENTION 1 | 1.00 | 6.1 | 1.6 | 6.0 |
| INVENTION 2 | 1.00 | 3.2 | 0.6 | 6.0 |
| INVENTION 3 | 1.00 | 3.2 | 1.8 | 6.0 |

| | PRIOR ART | THE PRESENT INVENTION | THE PRESENT INVENTION |
|---|---|---|---|
| NUMBER OF NOZZLES WHICH ARE NOT USED IN THE EJECTION OPERATION | 2 | 2 | 12 |
| THE OCCURRENCE FREQUENCY OF AN IMAGE DEFECT | 1.3% | 0.7% | 0.5% |

| | DUMMY NOZZLE | RESULT |
|---|---|---|
| PRIOR ART | 4 | △ |
| THE PRESENT INVENTION | 4 | ○ |
| THE PRESENT INVENTION | 14 | ◎ |

| | INK FLOW PIPE ($mm^2$) | INK SUPPLY DEVICE ($mm^2$) | COMMON LIQUID CHAMBER ($mm^2$) | RATIO OF SECTIONAL AREA $\left(\frac{\text{COMMON LIQUID CHAMBER}}{\text{INK SUPPLY DEVICE}}\right)$ |
|---|---|---|---|---|
| PRIOR ART | 0.79 | (1.87) | 3.30 | (1.76) |
| INVENTION 4 | 0.39 | 0.13 | 0.49 | 3.8 |
| INVENTION 5 | 0.39 | 0.39 | 1.31 | 3.4 |
| INVENTION 6 | 0.39 | 0.39 | 0.44 | 1.1 |

FIG. 15
| | DUMMY NOZZLE | RESULT |
|---|---|---|
| PRIOR ART | 3 (2) | × |
| THE PRESENT INVENTION | 3 (2) | ○ |
| THE PRESENT INVENTION | 13 (12) | ◎ |
FIG. 16
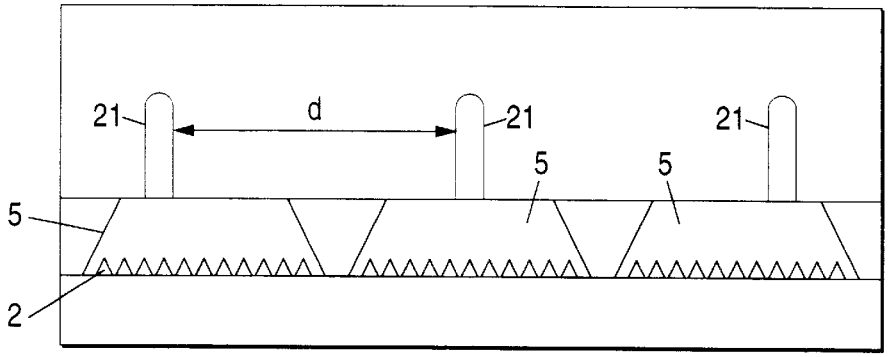
FIG. 17
PRIOR ART
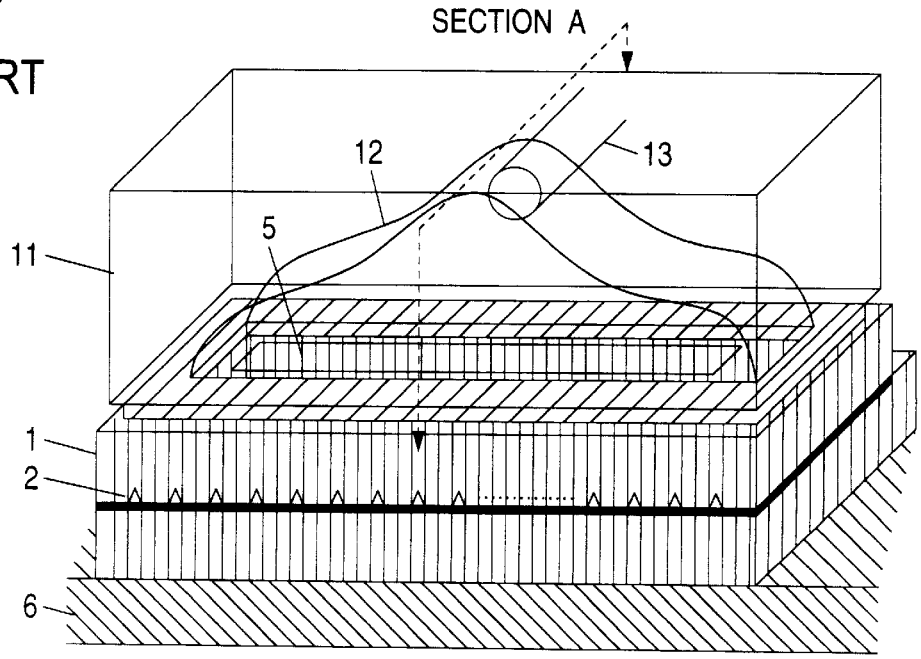

INK JET PRINTER AND INK JET PRINT HEAD

BACKGROUND OF THE INVENTION

The invention relates to an ink jet printer and an ink jet print head which comprise plural driving elements for ejecting ink, plural individual flow paths respectively corresponding to the nozzles, ejection ports corresponding to the flow paths, and a common liquid chamber for supplying ink to the individual flow paths, and in which ink is supplied to the common liquid chamber through an ink supply path.

Conventionally, as typical examples of an ink jet print head used in an ink jet printer, known are a piezoelectric ink jet print head in which a pressure chamber is mechanically deformed by a piezoelectric material and ink is ejected through an ink ejection port by the resulting pressure, and a thermal ink jet print head in which a heater disposed in the vicinity of an ink flow path is energized to evaporate ink and ink is ejected through an ink ejection port by the pressure produced by the evaporation.

FIG. 17 is a perspective view showing the vicinity of a head chip and an ink supply member in an example of an ink jet print head of the prior art, and FIG. 18 is a section view taken along a line A. In the figures, 1 designates a head chip, 2 designates nozzles, 3 designates individual flow paths, 4 designates heating elements, 5 designates a common liquid chamber, 6 designates a heat sink, 7 designates a circuit board, 8 designates bonding wires, 9 designates a sealant, 10 designates air bubbles, 11 designates an ink supply member, 12 designates an ink supply device, and 13 designates an ink flow pipe. FIGS. 17 and 18 show a thermal ink jet print head.

In the head chip 1, the plural individual flow paths 3 are formed and open in the outside so as to form the nozzles 2. The individual flow paths 3 internally communicate with the common liquid chamber 5. The heating elements 4 are disposed at midpoints of the individual flow paths 3, respectively. When the heating elements 4 generate heat, air bubbles are produced in the individual flow paths 3. The pressure of the produced air bubbles causes ink drops to be ejected through the nozzles 2, thereby performing the recording. The common liquid chamber 5 has an opening functioning as an ink inflow port.

The head chip 1 may be produced by, for example, bonding two silicon substrates together. In this case, the individual flow paths 3, the common liquid chamber 5, etc. are formed in one of the silicon substrates by anisotropic etching. The common liquid chamber 5 is formed by the anisotropic etching so as to pass through the silicon substrate, and the through hole is formed as the opening functioning as the ink inflow port. In the anisotropic etching, the silicon substrate is etched so as to form a predetermined angle. Therefore, each individual flow path 3 is formed into a triangular shape and the common liquid chamber 5 is formed into a shape which is expanded as moving from the opening to the inner portion. The communication between the individual flow paths 3 and the common liquid chamber 5 is directly performed by the anisotropic etching, or formed by grinding an unetched portion by means of dicing. Alternatively, a resin layer formed on the other substrate is etched to form bypass pits, thereby realizing the communication.

The ink supply member 11 has the ink supply device 12 and the ink flow pipe 13 which are used for supplying ink fed from an ink tank (not shown) to the head chip 1. The ink supply device 12 is formed as a substantially chevron space so that the opening is larger than the opening of the common liquid chamber 5 of the head chip 1. The object of this structure is to prevent ink turbulence from occurring, thereby reducing residual air bubbles. This structure is described in, for example, the Unexamined Japanese Patent Application Publication No. Hei 6-91874. The ink supply member 11 is fixed to the head chip 1 in such a manner that the opening of the ink supply device 12 communicates with that of the common liquid chamber 5 of the head chip 1.

The head chip 1 is fixed to the heat sink 6 so as to dissipate heat generated by the heating elements 4. Also the circuit board 7 is disposed on the heat sink 6 so that the power and signals supplied from the main unit of the printer are transmitted to the head chip 1 through the bonding wires 8, and signals and the like of various sensors disposed in the head chip 1 are transmitted to the printer main unit. In order to protect the bonding wires 8 and reinforce the fixation of the head chip 1 and the ink supply member 11, the sealant 9 is poured into a space defined by the ink supply member 11 and the heat sink 6.

Ink is fed from the ink tank which is not shown to the thus configured ink jet print head. The ink fed from the ink tank is supplied to the ink supply device 12 through the ink flow pipe 13 in the ink supply member 11, and then to the common liquid chamber 5 of the head chip 1 so as to be further supplied to the individual flow paths 3. The nozzles 2 open in the air. When no countermeasure is taken, therefore, ink leaks from the nozzles 2. To comply with this, the interior of each ink flow path is always maintained to have a negative pressure of 0 to −200 $mmH_2O$ by an ink impregnating member in the ink tank or a negative pressure generating mechanism.

In the ink jet print head, when air bubbles 10 stay in the ink supply device 12 or the common liquid chamber 5, the air bubbles 10 grow while the printer is used. The air bubbles 10 close the individual flow paths 3 so as to impede the ink supply, with the result that a printing failure is caused. In the thermal ink jet print head, particularly, ink is evaporated by heat generation of the heating elements 4, and hence the temperature of the ink is raised by the heat generated in this process. Then, air in the ink is precipitated and the air bubbles 10 in the common liquid chamber 5 gradually grow. Even in the case where only small air bubbles initially stay, therefore, the air bubbles finally impede the ejection. Since the growth of air bubbles is based on the heat generation as described above, air bubbles 10 tend to grow in the common liquid chamber 5 and at a portion where the ink supply device 12 is connected to the common liquid chamber 5. In the configuration described above, since the opening of the ink supply device 12 is larger than that of the common liquid chamber 5, the peripheral portion of the opening of the common liquid chamber 5 impedes the ink flow, so that air bubbles 10 easily grow in this portion. The air bubbles 10 which have grown to a larger size then enter the common liquid chamber 5 to impede the supply of ink to the individual flow paths 3, thereby causing an image defect.

FIG. 19 is a diagram illustrating the ink flow in the ink jet print head of the prior art, and FIG. 20 is a graph showing an example of the flow rate of ink in the head. As means for preventing an image defect due to air bubbles staying in the common liquid chamber from occurring, a method in which air bubbles staying in the common liquid chamber are removed away by sucking them through the nozzles 2 is usually employed. In FIG. 19, the arrows show the direction of the ink flow in the suction process. FIG. 20 shows the flow rates in the direction of the ink flow in various portions in this process. Also in a usual printing process, the ink flow direction is substantially identical with that shown in FIG. 19.

When ink is sucked through the nozzles 2, a quantity of ink which is equal to that of the sucked ink is fed from the ink tank which is not shown. The ink is supplied through the ink flow pipe 13 and enters the ink supply device 12. The ink then spreads along the shape of the ink supply device as shown in FIG. 19, and the flow rate is reduced as shown in FIG. 20. The ink in the ink supply device 12 further flows in the direction from the ink supply device 12 to the common liquid chamber 5 and then enters the common liquid chamber 5. The inferior of the common liquid chamber 5 is somewhat expanded, and hence the ink flow rate is further reduced. The direction of the ink flow which enters the common liquid chamber 5 is changed toward the individual flow paths 3, and then sucked out through the individual flow paths 3. Since the individual flow paths 3 have a small sectional area, the ink flow rate is higher.

When ink flows as described above, the ink flows are uniform in all the nozzles and hence a higher image quality can be realized. When air bubbles 10 stay in the common liquid chamber 5, however, the low ink flow rate in the common liquid chamber 5 makes the removal of the air bubbles 10 difficult. Furthermore, also the rate of the ink flow in the ink supply device 12 is low. Accordingly, when air bubbles 10 stay at a step formed in the portion where the ink supply device 12 is connected to the common liquid chamber 5, for example, the air bubbles 10 are hardly sucked even by conducting such a suction process. Consequently, the suction process fails to suck all the air bubbles 10 and the air bubbles tend to stay in the portion, with the result that an image defect which is so serious that a further suction process must be immediately conducted is produced. As a countermeasure, it may be contemplated that the suction process is repeated several times. As the suction process is conducted more frequently, however, the ink utilization efficiency for printing is lower, and a waste ink tank which is required for storing sucked ink must have a larger capacity, thereby producing a problem in that the size of the whole of an apparatus is increased.

Another configuration in which the side wall of a common liquid chamber is formed at an angle of 45° or less which is smaller than that in the above-mentioned configuration is described in, for example, the Unexamined Japanese Patent Application Publication No. Hei 3-110172. Also in this configuration, the ink flow spreads into a fan-like shape, and hence there arises the same problem as that discussed above.

SUMMARY OF THE INVENTION

The invention has been conducted in view of the above-discussed circumstances. It is an object of the invention to provide an ink jet printer and an ink jet print head in which the occurrence frequency of an image defect due to air bubbles is greatly lowered, the ink utilization efficiency for printing is improved, and a waste ink tank required for storing sucked ink has a smaller capacity, thereby reducing the size of an apparatus as a whole.

The ink jet printer of the invention is a printer which causes ink to fly to a recording medium to form an image, and which is characterized in that the printer comprises: plural nozzles functioning as ink ejection ports; plural individual flow paths which are disposed with respectively corresponding to the nozzles, the individual flow paths respectively having driving elements which eject internal ink through the nozzles; a common liquid chamber which communicates with the individual flow paths, the common liquid chamber having an opening portion through which ink is supplied into the chamber; an ink supply path which has a sectional area smaller than a sectional area of the opening portion of the common liquid chamber, the ink supply path being connected to the opening portion to guide ink to the common liquid chamber; and an ink supply source which can supply ink through the ink supply path.

According to another aspect of the invention, the printer has a head chip and an ink supply member; the nozzles, the individual flow paths, and the common liquid chamber are disposed in the head chip; the ink supply path is disposed in the ink supply member; and the head chip and the ink supply member are joined together, thereby connecting the ink supply path to the opening portion of the common liquid chamber.

According to another aspect of the invention, the ink supply path is formed into a pipe-like shape and directly connected to the opening portion of the common liquid chamber.

According to another aspect of the invention, the common liquid chamber is formed as a chamber elongating in an arrangement direction of the nozzles, and a direction of an ink flow in the common liquid chamber is different from a direction of an ink flow in the ink supply path.

According to another aspect of the invention, an area of a section of the common liquid chamber is four or less times the sectional area of the ink supply path, the section being perpendicular to the ink flow in the common liquid chamber.

According to another aspect of the invention, one or more of the nozzles are configured as dummy nozzles which are not used in recording, the one or more nozzles being in an end portion of the common liquid chamber.

According to another aspect of the invention, a part or all of the individual flow paths corresponding to the dummy nozzles have a lower flow resistance.

According to another aspect of the invention, ejection ports of the dummy nozzles are larger in size.

According to another aspect of the invention, opening portion of the common liquid chamber is deviated from a control portion of the common liquid chamber in an arrangement direction of the nozzles, and dummy nozzles which are disposed in an end portion of the common liquid chamber closer to the opening portion of the common liquid chamber are larger in number than dummy nozzles which are disposed in another end portion of the common liquid chamber remoter from the opening portion of the common liquid chamber.

According to another aspect of the invention, the ink supply path is slantly connected to the opening portion of the common liquid chamber.

According to another aspect of the invention, the head comprises: plural individual flow paths which are disposed with respectively corresponding to the nozzles, the individual flow paths respectively having driving elements which eject internal ink; a common liquid chamber which communicates with the individual flow paths, the common liquid chamber elongating in an arrangement direction of the nozzles and having an opening portion through which ink is supplied into the chamber; and an ink supply pipe which is directly connected to the opening portion of the common liquid chamber to guide ink to the common liquid chamber, a flow rate of ink in the ink supply pipe being higher than a flow rate of ink in the common liquid chamber.

According to another aspect of the invention, an area of a section of the common liquid chamber is four or less times a sectional area of the ink supply pipe, the section being perpendicular to the ink flow of the common liquid chamber.

According to another aspect of the invention, the ink supply pipe has a sectional area which is smaller than a sectional area of the opening portion of the common liquid chamber.

According to another aspect of the invention, the common liquid chamber is formed so as to be common to all of the nozzles and substantially uniform in the arrangement direction of the nozzles.

According to another aspect of the invention, the common liquid chamber is formed as a chamber elongating in the arrangement direction of the nozzles, and a direction of an ink flow in the common liquid chamber is different from a direction of an ink flow in the ink supply pipe.

BRIEF DESCRIPTION OF THE DRAWINGS

FIG. 15 is a view showing results of a printing experiment conducted on the configuration in which the second embodiment of the ink jet print head of the invention is modified so as to have dummy nozzles.

FIG. 16 is a section view showing the vicinity of a head chip and an ink supply member in a modification of the second embodiment of the ink jet print head of the invention.

FIG. 17 is a perspective view showing the vicinity of a head chip and an ink supply member in an example of an ink jet print head of the prior art.

DETAILED DESCRIPTION OF THE PREFERRED EMBODIMENTS

Figure 1:
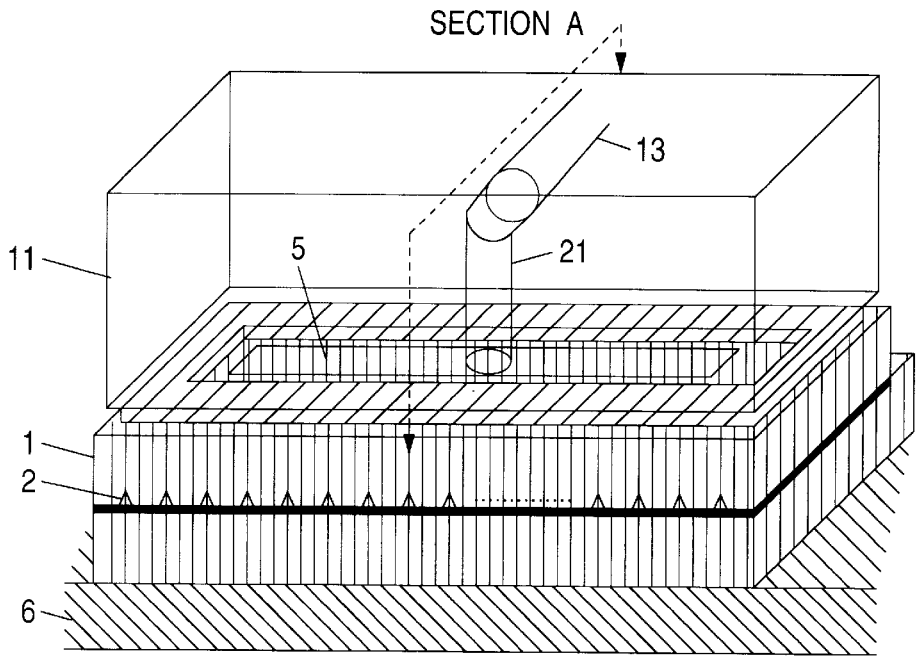
FIG. 1 is a perspective view showing the vicinity of a head chip and an ink supply member in a first embodiment of the ink jet print head of the invention.
Figure 2:
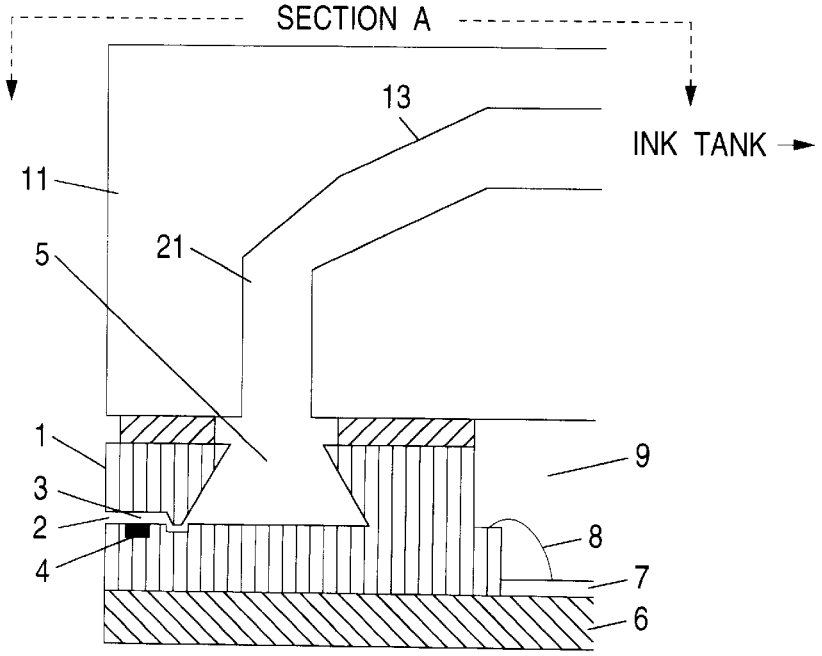
FIG. 2 is a section view taken along a line A in the vicinity of the head chip and the ink supply member in the first embodiment of the ink jet print head of the invention.
Figure 18:
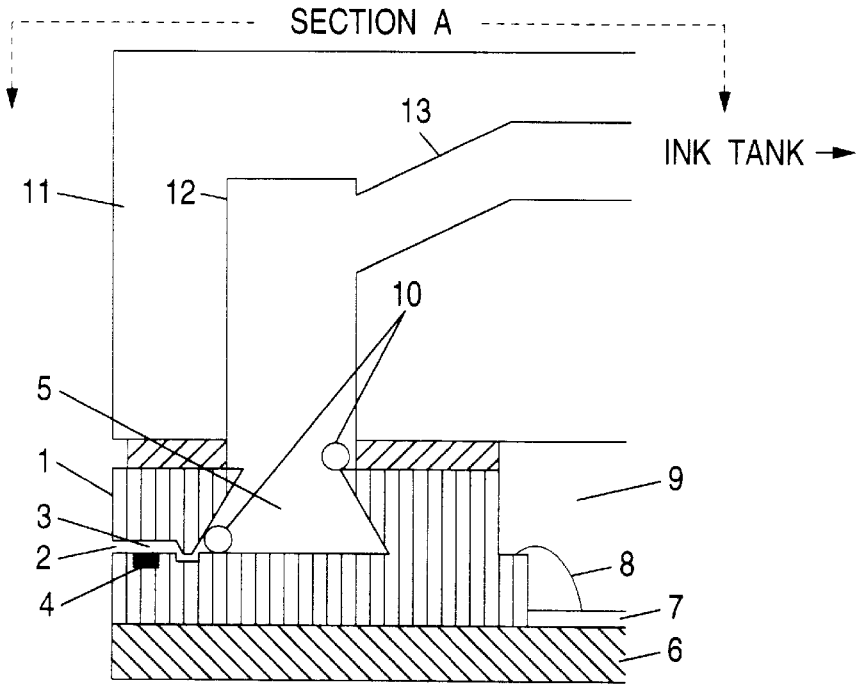
FIG. 18 PRIOR ART
FIG. 18 is a section view taken along a line A in the vicinity of the head chip and the ink supply member in the example of an ink jet print head of the prior art.

FIG. 1 is a perspective view showing the vicinity of a head chip and an ink supply member in a first embodiment of the ink jet print head of the invention, and FIG. 2 is a section view taken along a line A. In the figures, components which are the same as those shown in FIGS. 17 and 18 are designated by the same reference numerals and their description is omitted. The reference numeral 21 designates an ink supply device. The ink supply device 21 is disposed in the ink supply member 11 so as to communicate with the ink flow pipe 13. The opening of the ink supply device 21 is smaller in sectional area than that of the common liquid chamber 5 or the ink supply device 21 is included in the opening of the common liquid chamber 5. Particularly, the configuration in which the opening of the ink supply device 21 constitutes a part of the opening of the common liquid chamber 5 eliminates a projection which may be formed by the periphery of the opening of the common liquid chamber 5, whereby air bubbles are prevented from staying in this portion. The face of the ink supply member 11 functions as a cover for the portion of the opening of the common liquid chamber 5 other than that opposing the opening of the ink supply device 21. The ink supply device 21 may have an arbitrary sectional shape including a rectangular sectional shape. In order to prevent air bubbles from staying in a corner and facilitate the formation of the ink supply device, however, the ink supply device preferably has a circular or elliptic sectional shape. Alternatively, the ink supply device may have a semicircular, square, or triangular sectional shape.

Figure 3:
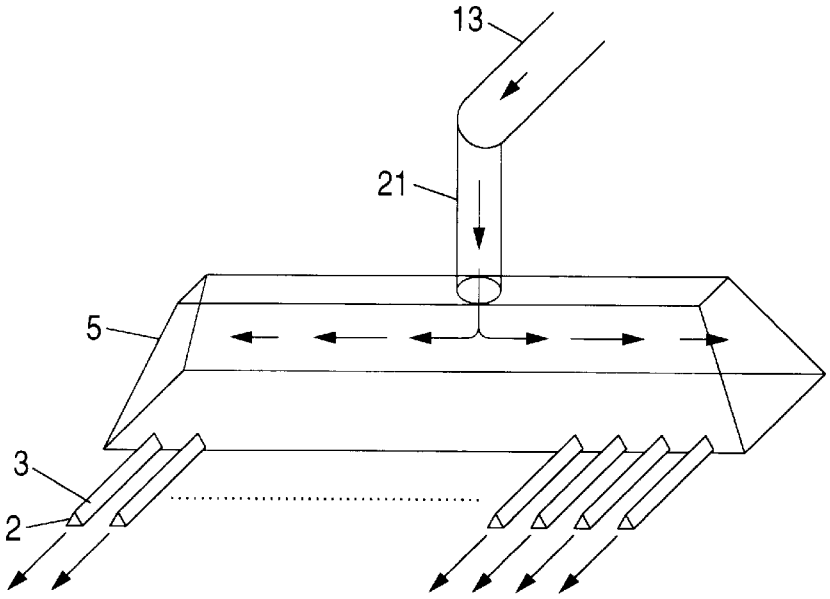
FIG. 3 is a diagram illustrating the ink flow in the first embodiment of the ink jet print head of the invention.
Figure 4:
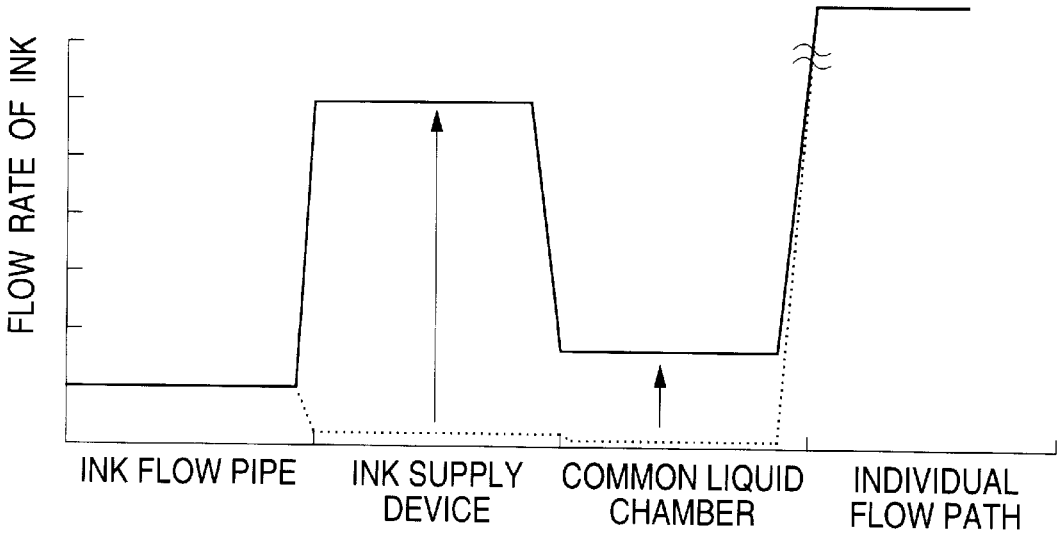
FIG. 4 is a graph showing an example of the flow rate of ink in the first embodiment of the ink jet print head of the invention.
Figure 19:
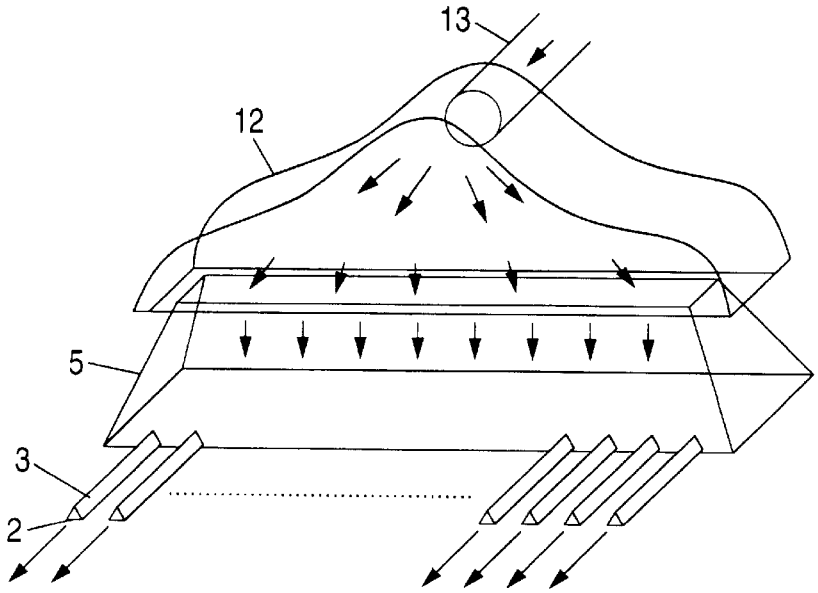
FIG. 19 PRIOR ART
FIG. 19 is a diagram illustrating the ink flow in the ink jet print head of the prior art.
Figure 20:
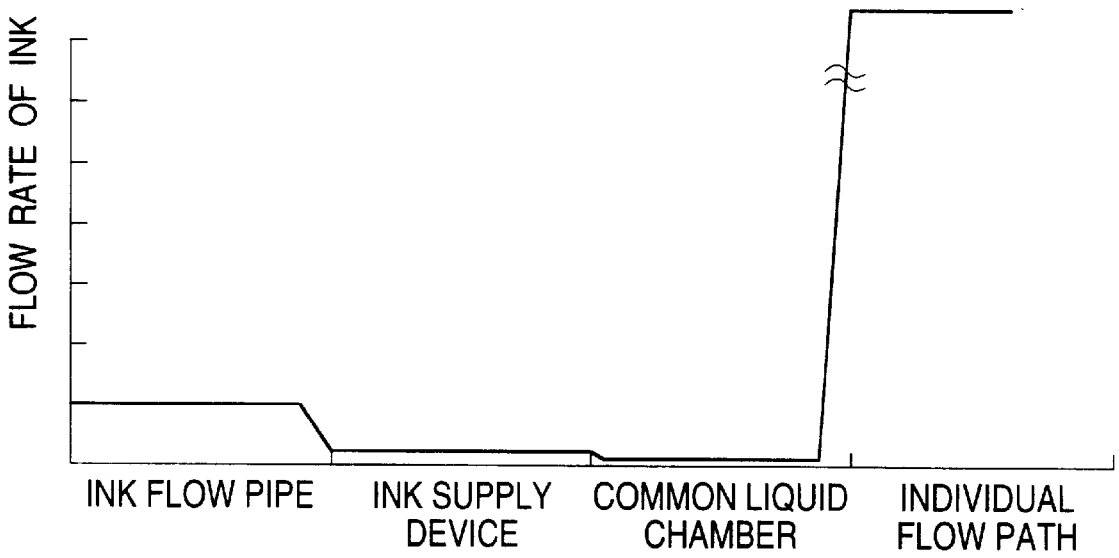
PRIOR ART FIG. 20
FIG. 20 is a graph showing an example of the flow rate of ink in the ink jet print head of the prior art.

FIG. 3 is a diagram illustrating the ink flow in the first embodiment of the ink jet print head of the invention, and FIG. 4 is a graph showing an example of the flow rate of ink in the head. In the same manner as FIGS. 19 and 20 described above, FIGS. 3 and 4 show the direction of the ink flow and the flow rates of ink in various portions of the ink inflow system including the common liquid chamber 5 in the case where the recovery operation is executed, i.e., where ink is sucked through the nozzles 2.

When ink in sucked, a quantity of ink which in equal to that of the sucked ink is fed from the ink tank which is not shown. In the embodiment, the sectional area of the ink supply device 21 is smaller than that of the ink supply device 12 in the prior art which is expanded as shown in FIGS. 17 and 18. As shown in FIG. 4, therefore, ink flows into the common liquid chamber 5 while maintaining the high flow rate of ink which is attained in the ink supply device 21. With respect to the direction of the ink flow, since the ink supply device 21 has a straight pipe-like shape, ink flows only along the shape of the ink supply device 21.

When ink enters the interior of the common liquid chamber 5, as shown in FIG. 3, the direction of the ink flow is changed so as to coincide with the arrangement direction of the nozzles 2 and the ink then flows toward the end portions of the common liquid chamber 5. The direction of the ink flow is different from that in the head of the prior art structure shown in FIG. 19. In the prior art, the plane which is perpendicular to the ink flow is the one which is substantially parallel to the opening of the common liquid chamber 5. By contrast, in the invention, the plane which is perpendicular to the ink flow is the one which is perpendicular to the arrangement direction of the nozzles 2. In this way, the plane which is perpendicular to the ink flow in the embodiment is different from that in the prior art. Even if the common liquid chamber 5 in the embodiment is identical in shape with that in the prior art, therefore, the ink flow rates in both the cases are different from each other. As seen from the comparison of FIGS. 4 and 20, in the invention, the section which is perpendicular to the ink flow has a smaller area, and hence the flow rate of ink in the common liquid chamber 5 is higher. In the prior art, for one color, the common liquid chamber 5 is sometimes formed so as to be partitioned into several cells. In the embodiment, the common liquid chamber 5 for one color is configured by a single chamber which is substantially uniform, whereby the quantity of flow of ink is increased and the flow rate of ink is raised.

In this way, the flow rate of ink in both the ink supply device 21 and the common liquid chamber 5 can be raised. The places where the flow rate of ink is low are restricted to the end portions of the common liquid chamber 5. Even if air bubbles are produced and grow in the ink supply device 21 and the common liquid chamber 5, therefore, the air bubbles are swept into the end portions. The air bubbles are then discharged through the nozzles in the vicinity of the end portions by the recovery operation based on suction. In this way, air bubbles can be sucked through the individual flow paths 3 by the ink flow caused by suction. Therefore, it is possible to configure a small printer in which air bubbles are prevented from staying in the print head, and the number of recovery operations to be conducted can be reduced so that the ink utilization efficiency for printing is improved and a waste ink tank can be made small in size.

Figures 5, 6, 7:
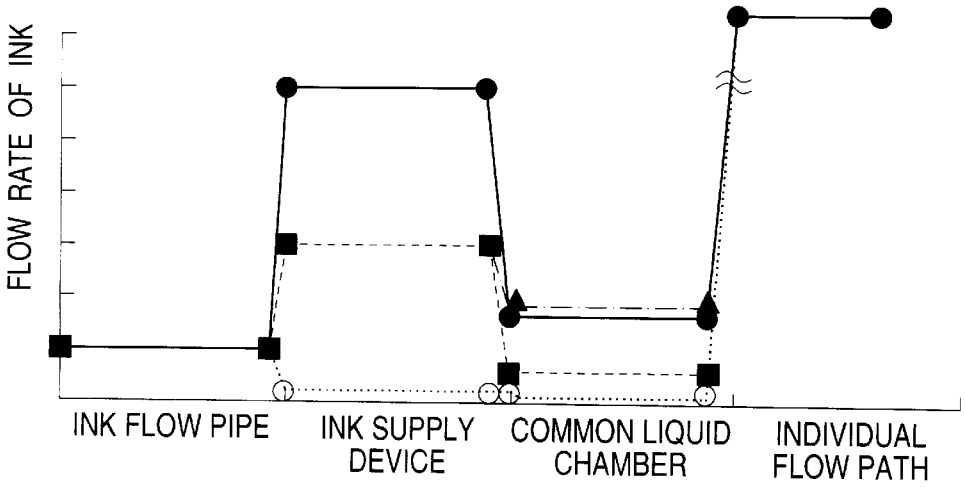
FIG. 5 is a view showing comparisons of sectional areas of various portions between specific examples of the first embodiment of the ink jet print head of the invention and a specific example of the prior art.
FIG. 6 is a view showing comparisons of flow rates in various portions between specific examples of the first embodiment of the ink jet print head of the invention and a specific example of the prior art.
FIG. 7 is a graph showing flow rates in various portions in the heads of specific examples of the first embodiment of the ink jet print head of the invention and a specific example of the prior art.

FIG. 5 is a view showing comparisons of sectional areas of various portions between specific examples of the first embodiment of the ink jet print head of the invention and a specific example of the prior art. In the figure, three heads are used as specific examples of the configuration of the first embodiment, and the sectional areas in the ink flow direction of the ink flow pipe 13, the ink supply device 21, and the common liquid chamber 5 in each of the heads are shown. Also the ratio of the sectional area of the common liquid chamber 5 to that of the ink supply device 21 is shown in the figure.

In the head indicated by "Invention 1," the ink supply device 21 has a diameter of 0.4 mm and is connected to the common liquid chamber 5 having an opening width of 0.5 mm. In the heads indicated by "Invention 2" and "Invention 3," the ink supply device 21 has a diameter of 0.7 mm and is connected to the common liquid chamber 5 having an opening width of 0.8 mm. In "Invention 3," anisotropic etching is conducted on both the faces of a silicon substrate in the formation of the common liquid chamber 5, so that the common liquid chamber 5 of a small size is formed. In all the three examples, the head has a width of 11.1 mm and the common liquid chamber 5 has a length which is slightly smaller than the value.

On the other hand, in the prior art head, the sectional area of the connecting portion of the ink supply device is larger than the area of the opening of the common liquid chamber 5, and hence very larger than the sectional area of the ink supply device 21 in the invention. Since the flow direction of ink is different from that in the invention, the sectional area in the ink now direction of the common liquid chamber 5 is that of a plane which is parallel to the opening portion of the common liquid chamber and hence is very larger than those of the heads of the invention. By contrast, in all the examples of the invention, the sectional area of the ink supply device 21 is much smaller than that of the ink supply device of the prior art having an expanding shape. With respect to the sectional area in the ink flow direction of the common liquid chamber 5, the heads of the invention are smaller than the head of the prior art.

In the invention, the sectional area of the ink supply device 21 is made small and the direction of the ink flow in the common liquid chamber 5 is changed so that the sectional area in the direction of the ink flow is smaller than that in the prior art. When it is assumed that the sucked quantity of ink is constant, therefore, the ink flow rate in these portions can be made higher. FIG. 6 is a view showing comparisons of flow rates in various portions between specific examples of the first embodiment of the ink jet print head of the invention and a specific example of the prior art, and FIG. 7 is a graph showing flow rates in various portions in the heads. In FIG. 7, the solid line indicates flow rates in various portions in "Invention 1," the broken line indicates those in "Invention 2," the one-dot chain line indicates those in "Invention 3," and the dotted line indicates those in "Invention 4." As shown in FIGS. 6 and 7, it will be seen that, in all the heads using the configuration of the first embodiment of the invention, the ink flow rates in the ink supply device 21 and the common liquid chamber 5 are higher than those in the prior art head.

In the specific examples, the ratio of the sectional area of the common liquid chamber 5 to that of the ink supply device 21 is set to be 4 or less. When the ratio is set to be excessively large, the flow rate in the common liquid chamber 5 is lowered and there arises a fear that air bubbles cannot be sufficiently sucked. To comply with this, also the sectional area in the ink flow direction of the common liquid chamber 5 is reduced to some extent so that the quantity of flow of ink is ensured, thereby facilitating the removal of air bubbles by suction.

In the first embodiment of the invention, the ink ejection is unstable in the end portions of the common liquid chamber 5 and air bubbles tend to stay therein, because of the shape of the chamber. As described in, for example, the Unexamined Japanese Patent Application Publication No. Hei 5-138884, therefore, nozzles in the end portions may be configured as dummy nozzles which are not used in the recording. In the configuration of the invention, particularly, the ink flow is faster as moving toward an end portion of the common liquid chamber 5 as described above, and therefore the places where air bubbles may stay are restricted to the end portions of the common liquid chamber 5. For these reasons, also in the invention, dummy nozzles may be disposed. Several nozzles in each of the end portions may be used as dummy nozzles. The dummy nozzles can be configured in the same manner as the other nozzles which are used in the recording. Alternatively, in a part or all of the dummy nozzles, the heating element 4 may not be disposed in the individual flow path 3, so that these dummy nozzles function as nozzles which cannot eject ink. As far as the individual flow paths 3 corresponding to the dummy nozzles communicate with the common liquid chamber 5, the ink suction can be conducted also through the dummy nozzles in the suction operation, thereby allowing air bubbles to be removed. Specifically, in a head having 188 nozzles, for example, 10 nozzles in each end portion may be configured as dummy nozzles.

Figures 8, 9, 10:
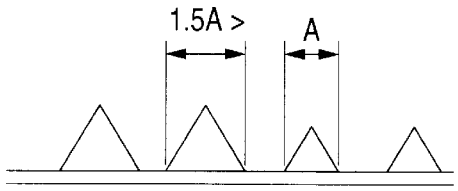
FIG. 8 is an enlarged view showing a portion where dummy nozzles are formed in the first embodiment of the ink jet print head of the invention.
FIG. 9 is a view showing results of an other printing experiment conducted on the configuration in which the first embodiment of the ink jet print head of the invention is modified so as to have dummy nozzles.
FIG. 10 is a view showing results of a further printing experiment conducted on the configuration in which the first embodiment of the ink jet print head of the invention is modified so as to have dummy nozzles.

FIG. 8 is an enlarged view showing a portion where dummy nozzles are formed in the first embodiment of the ink jet print head of the invention. Air bubbles tend to stay in the portion where the dummy nozzles communicate with the common liquid chamber 5. Therefore, the head may be configured so that air bubbles are easily removed from the portion together with ink during the suction operation as described above. FIG. 8 shows an example in which the sectional area of the dummy nozzles is larger than that of the other nozzles which are used in the recording. For example, the sectional area of the dummy nozzles may be about two times that of the other nozzles.

Alternatively, the individual flow paths 3 corresponding to the dummy nozzles may be structured so as to have a reduced flow resistance, thereby realizing a configuration in which ink can be easily sucked through the dummy nozzles and the removal of air bubbles can be efficiently conducted. Specifically, in a head where the above-mentioned bypass pits are used, the flow resistance may be reduced by, for example, directly connecting the individual flow paths 3 to the common liquid chamber 5. The reduction of the flow resistance of the individual flow paths 3 corresponding to the dummy nozzles may be realized by another method.

FIG. 9 is a view showing results of another printing experiment conducted on the configuration in which the first embodiment of the ink jet print head of the invention is modified so as to have dummy nozzles. Ink jet print heads which are configured as shown in FIGS. 1 and 2 and have dummy nozzles were actually produced, and then subjected to the printing experiment. As a result, in the case where dummy nozzles of the same number are formed, the occurrence frequency of a defect pixel in the prior art head was about 1.3%, and that in the head configured in accordance with the first embodiment was reduced to 0.7%. In this way, according to the invention, the reduction of the occurrence rate of an image defect due to air bubbles in the common liquid chamber 5 was realized by increasing the flow rate and improving the flow rate distribution in the common liquid chamber 5.

As described above, in the invention, the places where air bubbles stay are restricted to the end portions of the common liquid chamber 5. The occurrence of an image defect due to air bubbles can be suppressed by setting the nozzles in the end portions of the common liquid chamber 5 so as not to be used in the ejection operation. As shown in FIG. 9, an experiment was conducted in which the number of dummy nozzles which are in the end portions of the common liquid chamber 5 and not used in the printing was increased to 20. The results of the experiment show that the occurrence of an image defect due to air bubbles can be suppressed to about 0.5% by increasing of the number of dummy nozzles.

FIG. 10 is a view showing results of a further printing experiment conducted on the configuration in which the first embodiment of the ink jet print head of the invention is modified so as to have dummy nozzles. In the experiment, for each head, one recovery operation was conducted after printing of 100 sheets and the ink tank was replaced with a fresh one after further printing of 100 sheets. After these operations were performed for three ink tanks or printing of 600 sheets was conducted, dots of printing failure were counted. An allowable number of printing failure dots was set as a target. The average m of the numbers of printing failure dots, and $m+3\sigma$ where $\sigma$ is the standard deviation were statistically checked for each head to judge whether they reach the target or not.

The results of the experiment show that, when four dummy nozzles were used in the prior art head, both the average m and $m+3\sigma$ failed to reach the target and, when four dummy nozzles were used in the head according to the invention, the average reached the target. From the above, it will be seen that the structure of the invention is effective. When the number of dummy nozzles was increased or fourteen dummy nozzles were used, both the average m and $m+3\sigma$ reached the target. Namely, it was possible to reduce the number of printing failure dots to the target or less with a probability of 99.9%.

Figure 11:
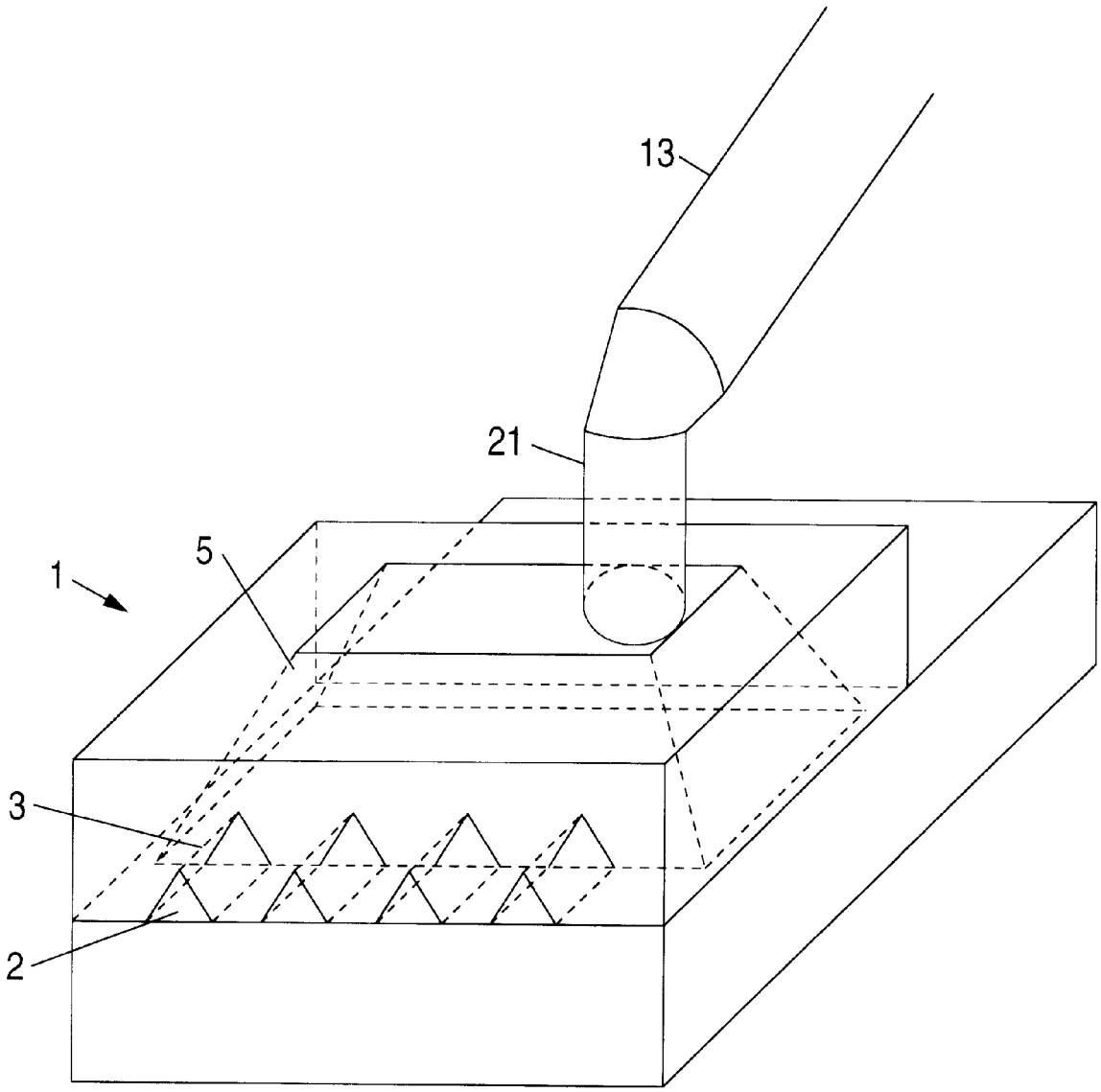
FIG. 11 is a perspective view showing the vicinity of a head chip and an ink supply member in a modification of the first embodiment of the ink jet print head of the invention.

FIG. 11 is a perspective view showing the vicinity of a head chip and an ink supply member in a modification of the first embodiment of the ink jet print head of the invention. In the modification, for convenience of production of the ink jet print head, the ink supply device 21 communicate with the common liquid chamber 5 with being shifted to one end portion of the opening of the common liquid chamber 5. Also in the configuration, the same effects are attained. In the configuration, the ink flow in the end portion which is more remote from the connecting portion of the common liquid chamber 5 and the ink supply device 21 is slower than that in the other end portion which is nearer the connecting portion. Consequently, air bubbles stay more easily in the remote end portion. When dummy nozzles are to be disposed, therefore, the number of the dummy nozzle disposed in the end portion more remote from the connecting portion of the ink supply device 21 may be set to be larger than that of the dummy nozzles disposed in the nearer end portion. According to this configuration, the occurrence rate or an image defect due to residual air bubbles can be reduced and the distribution of the ink flow rate in the nozzles for ejecting ink can be maintained to be constant. In place of setting the number of dummy nozzles as described above, the flow resistance of the dummy nozzles disposed in the side remoter from the ink supply device 21 may be set to be lower than that of the dummy nozzles disposed in the nearer side.

Figure 12:
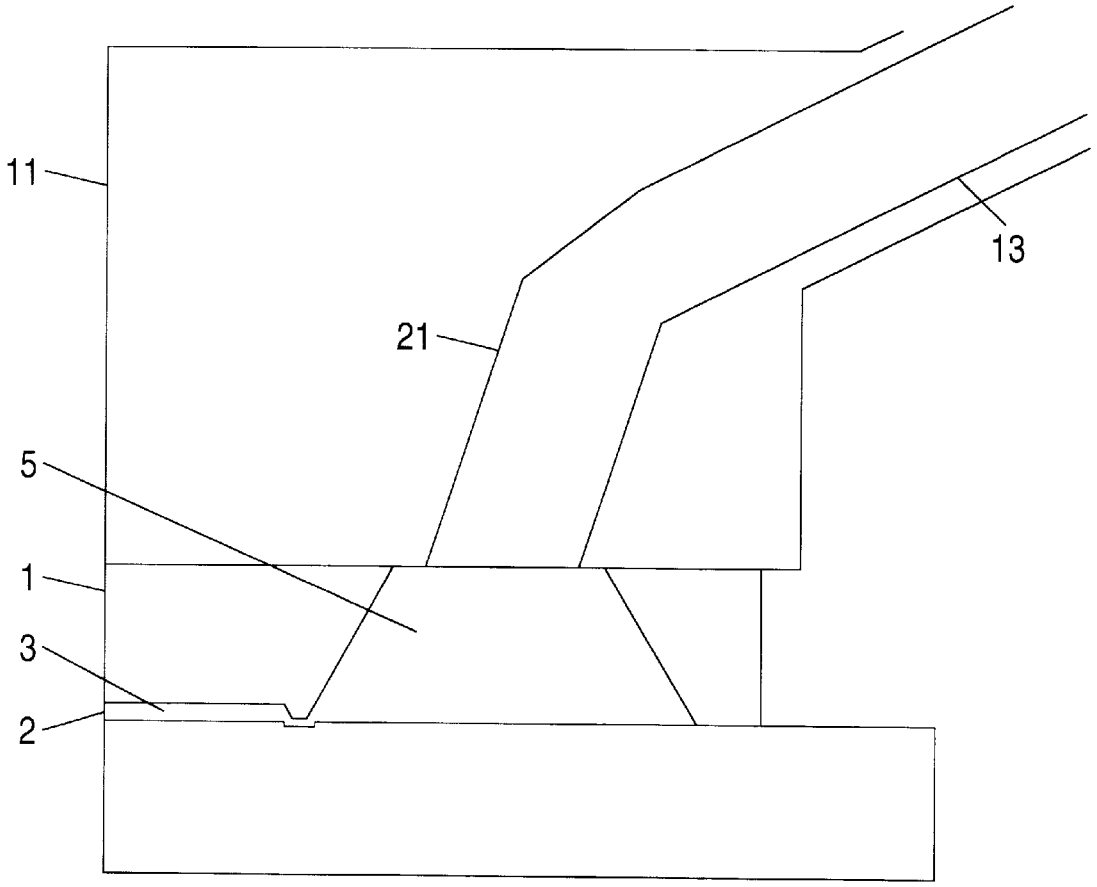
FIG. 12 is a perspective view showing the vicinity of a head chip and an ink supply member in another modification of the first embodiment of the ink jet print head of the invention.

FIG. 12 is a perspective view showing the vicinity of a head chip and an ink supply member in another modification of the first embodiment of the ink jet print head of the invention. In the modification, the ink supply device 21 is disposed so as to be slant with respect to the head chip 1. More specifically, the ink supply device 21 is attached to the head chip 1 so as to be backward slanted at a small angle to the ink ejection direction. According to this configuration, the ink flow in the ink supply device 21 and the common liquid chamber 5 is oriented to a direction toward the individual flow paths 3, and hence it is possible to efficiently remove air bubbles which may close the individual flow paths 3 communicating with the nozzles 2 and having the greatest necessity for removal of air bubbles.

Figures 13, 14:
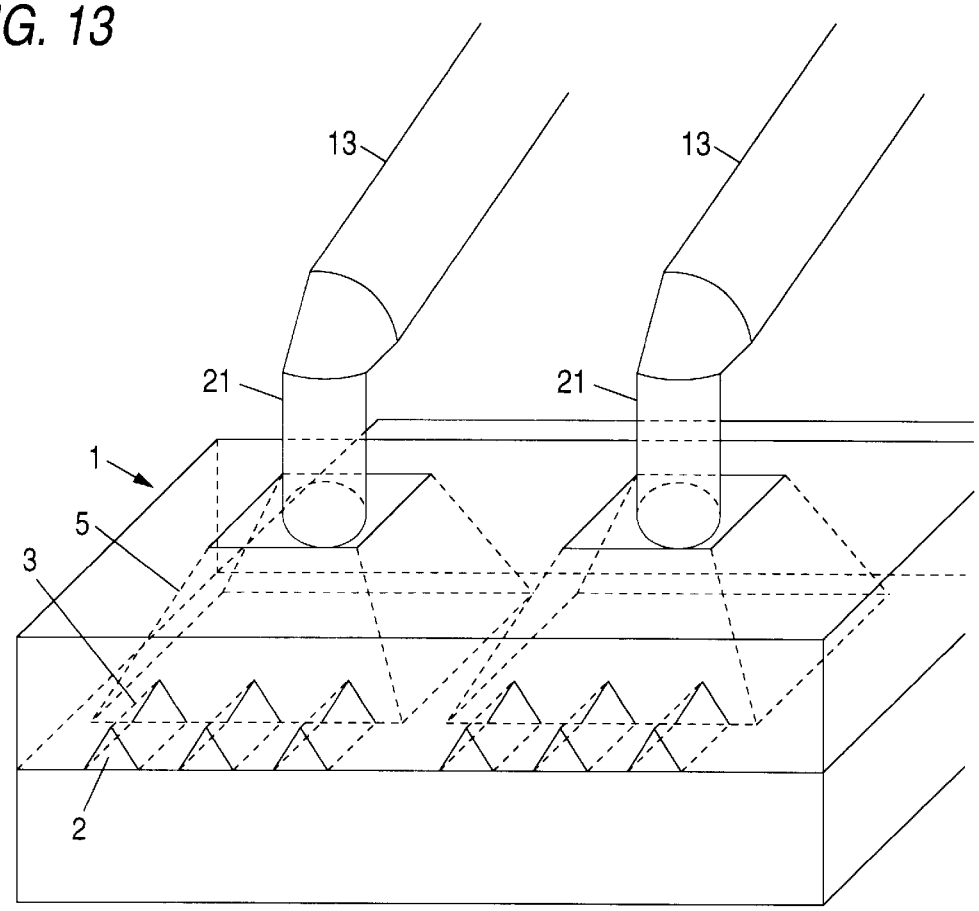
FIG. 13 is a perspective view showing the vicinity of a head chip and an ink supply member in a second embodiment of the ink jet print head of the invention.
FIG. 14 is a view showing comparisons of sectional areas of various portions between specific examples of the second embodiment of the ink jet print head of the invention and a specific example of the prior art.

FIG. 13 is a perspective view showing the vicinity of a head chip and an ink supply member in a second embodiment of the ink jet print head of the invention. The heads or the first embodiment are recording heads for a monocolor such as black. The invention is not restricted to this and can be applied to a head which can perform the multicolor printing. Such a head which can perform the multicolor printing is described in, for example, the Japanese Patent Application No. Hei 7-103662.

As shown in FIG. 13, in the head of the second embodiment, plural nozzles are separated into groups in accordance with the color used in the nozzles. The common liquid chamber 5 is formed for each of the groups, and inks of respective colors are supplied to the common liquid chambers 5 through the ink supply devices 21. In other words, each group is configured in the same manner as the first embodiment. Also in this embodiment, the sectional area of the connecting portion of each ink supply device 21 is smaller than that of the opening portion of the corresponding common liquid chamber 5.

FIG. 14 is a view showing comparisons of sectional areas of various portions between specific examples of the second embodiment of the ink jet print head of the invention and a specific example of the prior art, in a substantially same manner as FIG. 5 described above. The figure shows data with respect to one of the ink supply devices 21 and one of the common liquid chambers 5 of a head such as shown in FIG. 13 which can perform the multicolor printing.

In FIG. 14, "Invention 4" to "Invention 6" correspond is to "Invention 1" to "Invention 3" in FIG. 5, respectively. In the head indicated by "Invention 4," the ink supply devices 21 have a diameter of 0.4 mm and are connected to the common liquid chambers 5 having an opening width of 0.5 mm. In the heads indicated by "Invention 5" and "Invention 6," the ink supply devices 21 have a diameter of 0.7 mm and are connected to the common liquid chambers 5 having an opening width of 0.8 mm. In "Invention 6," anisotropic etching is conducted on both the faces of a silicon substrate in the formation of the common liquid chambers 5, so that the common liquid chambers 5 of a small size are formed. In all the three examples, the head of one color has a width of 3.6 mm and one common liquid chamber 5 has a length which is slightly smaller than the value.

On the other hand, in the prior art head, the sectional area of the connecting portion of the ink supply devices is larger than the area of the opening of the common liquid chambers 5, and hence very larger than the sectional area of the ink supply devices 21 in the invention. Since the flow direction of ink is different from that in the invention, the sectional area in the ink flow direction of the common liquid chambers 5 is that of a plane which is parallel to the opening portion of the common liquid chambers and hence very larger than those of the heads of the invention. By contrast, in all the examples of the invention, the sectional area of the ink supply devices 21 is very smaller than that of the ink supply devices of the prior art having an expanding shape. With respect to the sectional area in the ink flow direction of the common liquid chambers 5, the heads of the invention are smaller than the head of the prior art.

Also in the second embodiment of the invention, the sectional area of the ink supply devices 21 is made small and the direction of the ink flow in the common liquid chambers 5 is changed so that the sectional area in the direction of the ink flow is smaller than that in the prior art. When it is assumed that the sucked quantity of ink is constant, the ink flow rate in these portions can be made higher. Also in the specific examples, the ratio of the sectional area of the common liquid chambers 5 to that of the ink supply devices 21 is set to be 4 or less in order to ensure the quantity of flow of ink in the suction operation.

Also in the second embodiment of the invention, for each of the groups, dummy nozzles may be disposed in the end portions of the common liquid chamber 5. When inks of plural colors are used as in the case of the second embodiment, inks of different colors which are juxtaposed may be caused to be mixed with each other by ink adhering or sputtered to the vicinity of the nozzles. The dummy nozzles are used also for preventing the image quality from being lowered by such color mixing. In this case, color mixing is prevented from occurring by ejecting ink. In the second embodiment, therefore, it is preferable to configure at least a part of the dummy nozzles which are on the side of the ink ejecting nozzles, so as to be able to eject ink. In the same manner as the first embodiment, the dummy nozzles may be structured so that the flow resistance is lowered by increasing the sectional area or changing the structures of the flow paths. In a head having 56 nozzles for one color, for examples, eight nozzles in each of the end portions may be used as dummy nozzles. Among the dummy nozzles, preferably, dummy nozzles adjacent to another color are configured so as to be able to perform ejection.

FIG. 15 is a view showing results of a printing experiment conducted on the configuration in which the second embodiment of the ink jet print head of the invention is modified so as to have dummy nozzles. Integral three-color ink jet print heads in which the ink supply devices 21 are smaller in sectional area than the common liquid chambers 5 and which have dummy nozzles were actually produced, and then subjected to the printing experiment in the same manner as that shown in FIG. 10. In the column of the number of dummy nozzles in the figure, each value in parentheses indicates the number of dummy nozzles in the portion adjacent to another color.

The results of the experiment show that, when three dummy nozzles are disposed in the ends of the prior art head and two dummy nozzles are disposed in the portions adjacent to another color, both tho average m and m+3σ failed to reach the target and, when dummy nozzles of the same numbers were used in the head according to the invention, the average reached the target. From the above, it will be seen that the structure or the invention is effective. When the number of dummy nozzles was increased or thirteen dummy nozzles in the ends of the head and twelve dummy nozzles are disposed in the portions adjacent to another color, both the average m and m+3σ reached the target. Namely, it was possible to reduce the number of printing failure dots to the target or less with a probability of 99.9%.

FIG. 16 is a section view showing the vicinity of a head chip and an ink supply member in a modification of the second embodiment of the ink jet print head of the invention. As shown in the modification, in the head which can perform the multicolor printing, the plural ink supply devices 21 are connected to the corresponding common liquid chambers 5. respectively. On occasion, the distance d between the ink supply devices 21 must be kept to be constant because of restrictions in production. In such a case, in the same manner as the example shown in FIG. 11, some of the ink supply devices 21 may be connected to one end portion of the opening of the corresponding common liquid chamber 5, in place of the center of the opening. FIG. 16 shows the example of an integral three-color head. In the center common liquid chamber 5 of the example, the ink supply device 21 is connected to the center of tho opening, and, in each of the right and left common liquid chamber 5, the ink supply device 21 is connected to the rightward or leftward deviated position of the opening.

When the configuration shown inn FIG. 16 is provided with dummy nozzles, for example, the dummy nozzles are preferably disposed in the following manner. In the left common liquid chamber 5, the number of dummy nozzles in the left side or the side of the end portion of the head is smaller, and that of dummy nozzles in the side adjacent to the center common liquid chamber 5 is larger. The right common liquid chamber 5 is configured in a similar manner.

In the view point of preventing the color mixing from occurring, the numbers of the dummy nozzles in the sides adjacent to the center common liquid chamber 5 may be increased. In the center common liquid chamber 5, the numbers of the dummy nozzles in both the sides may be equal to each other.

Also in the thus configured ink jet print head, the flow rate in the common liquid chambers can be increased, the occurrence frequency of an image defect due to air bubbles can be lowered, and the ink utilization efficiency for printing can be improved. Since the number of recovery operations to be conducted can be reduced, a waste ink tank required for storing sucked ink can have a smaller capacity, thereby enabling an ink jet printer of a small size to be configured.

As apparent from the above description, according to the invention, the sectional area of the ink supply path for supplying ink to the common liquid chamber is smaller than that of the opening of the common liquid chamber, and hence the ink flow in the common liquid chamber during execution of the recovery operation is oriented to the arrangement direction of the nozzles so that the sectional area is reduced, whereby the flow rate of ink can be raised. The ink supply path can communicate with the common liquid chamber without forming a projection which may cause air bubbles to stick or stay. Furthermore, and no obstruction is formed in the arrangement direction of the ejection ports in the common liquid chamber. Therefore, produced air bubbles are accumulated in the ends or one end of the common liquid chamber and then sucked by the recovery operation, with the result that the quantity of residual air bubbles is greatly reduced. Even if air bubbles remain to stay, the portions where air bubbles remain to stay are restricted. Therefore, the nozzles in the portions may be used as dummy nozzles so as not to be used in the printing. As a result, the timing when residual air bubbles adversely affect the printing can be delayed. In this way, the occurrence frequency of an image defect due to air bubbles is greatly lowered. Therefore, the invention can attain the effects that the ink utilization efficiency for printing is improved, and that a waste ink tank required for storing sucked ink has a smaller capacity, whereby the size of an apparatus can be reduced as a whole.

What is claimed is:

1. An ink jet print head which causes ink to fly to a recording medium to form an image, comprising:

plural nozzles that eject ink, one or more of said nozzles configured as dummy nozzles which are not used in recording;

plural individual flow paths respectively corresponding to said nozzles, said individual flow paths having respective driving elements which convey internal ink through said nozzles;

a common liquid chamber which communicates with said individual flow paths, said common liquid chamber having an opening portion with an opening portion cross section through which ink is supplied into said chamber, said common liquid chamber having a cross section greater than the opening portion cross section in a flow direction from said opening portion to said plural individual flow paths, said common liquid chamber having an end portion with said one or more nozzles, wherein said opening portion of said common liquid chamber is deviated from a center portion of said common liquid chamber in an arrangement direction of said nozzles, and dummy nozzles which are disposed in an end portion of said common liquid chamber closer to said opening portion of said common liquid chamber are larger in number than dummy nozzles which are disposed in another end portion of said common liquid chamber remoter from said opening portion of said common liquid chamber;

an ink supply path which has a sectional area not greater than than a sectional area of said opening portion of said common liquid chamber, said ink supply path being connected to said opening portion to guide ink to said common liquid chamber; and an ink supply source positioned upstream of and connected to said ink supply path for supplying ink through said ink supply path.

2. The ink jet print head of claim 1, wherein said print head includes a head chip portion, and an ink supply portion;

said head chip portion having said plural nozzles, said plural individual flow paths, and said common liquid chamber; and said ink supply portion having said ink supply path; and wherein said head chip portion and said ink supply portion are joined together, thereby connecting said ink supply path to said opening portion of said common liquid chamber.

3. The ink jet print head of claim 1, wherein said ink supply path has a pipe-like shape, and is directly connected to said opening portion of said common liquid chamber.

4. The ink jet print head of claim 1, wherein said common liquid chamber is formed as a chamber elongating in an arrangement direction of said nozzles, and a direction of an ink flow in said common liquid chamber is different from a direction of an ink flow in said ink supply path.

5. The ink jet print head of claim 4, wherein a largest sectional area of said common liquid chamber is four or less times the sectional area of said ink supply path, said section being perpendicular to the ink flow in said common liquid chamber.

6. The ink jet print head of claim 1, wherein a part or all of the individual flow paths corresponding to said dummy nozzles have a lower flow resistance.

7. The ink jet print head of claim 1, wherein ejection ports of said dummy nozzles are larger in size.

8. The ink jet print head of claim 1, wherein said ink supply path is slantly connected to said opening portion of said common liquid chamber.

* * * * *